US009279274B2

(12) United States Patent
MacDonald

(10) Patent No.: US 9,279,274 B2
(45) Date of Patent: Mar. 8, 2016

(54) LOCK

(75) Inventor: Grant MacDonald, Ascot (GB)

(73) Assignee: CODELOCKS LIMITED, Newbury (GB)

( * ) Notice: Subject to any disclaimer, the term of this patent is extended or adjusted under 35 U.S.C. 154(b) by 209 days.

(21) Appl. No.: 13/129,080

(22) PCT Filed: Nov. 12, 2009

(86) PCT No.: PCT/GB2009/002656

§ 371 (c)(1),
(2), (4) Date: May 12, 2011

(87) PCT Pub. No.: WO2010/055298

PCT Pub. Date: May 20, 2010

(65) Prior Publication Data

US 2011/0226026 A1 Sep. 22, 2011

(30) Foreign Application Priority Data

Nov. 13, 2008 (GB) ..... 0820823.3

(51) Int. Cl.
*E05B 37/00* (2006.01)
*E05B 37/16* (2006.01)

(52) U.S. Cl.
CPC ..... *E05B 37/16* (2013.01); *E05B 37/0048* (2013.01); *E05B 37/0034* (2013.01); *E05B 37/163* (2013.01); *Y10T 70/7141* (2015.04); *Y10T 70/735* (2015.04)

(58) Field of Classification Search
USPC ..... 70/213, 214, 219, 294, 287, 288, 70/297–301, 304–312, 327
See application file for complete search history.

(56) References Cited

U.S. PATENT DOCUMENTS

| | | | | |
|---|---|---|---|---|
| 4,794,768 | A * | 1/1989 | Moser et al. | 70/165 |
| 4,936,894 | A * | 6/1990 | Larson et al. | 70/298 |
| 5,058,404 | A | 10/1991 | Fish et al. | |
| 5,186,032 | A * | 2/1993 | Chia | 70/315 |
| 6,298,698 | B1 * | 10/2001 | Nakajima et al. | 70/214 |
| 6,334,346 | B1 * | 1/2002 | Wang | 70/214 |

(Continued)

FOREIGN PATENT DOCUMENTS

| | | | |
|---|---|---|---|
| EP | 0 472 292 | A2 | 2/1992 |
| EP | 1 164 237 | A1 | 12/2001 |
| GB | 2 343 482 | A | 5/2000 |

*Primary Examiner* — Christopher Boswell
(74) *Attorney, Agent, or Firm* — Sughrue Mion, PLLC

(57) ABSTRACT

A lock comprises a housing defining a mounting face, a locking mechanism accommodated in the housing and operable to change between a locking state and a release state and a set of operating elements with buttons accessible at the front of the housing and actuable, such as by axial displacement, to operate the locking mechanism. The locking mechanism can be changed from the locking state to the release state in response to actuation of, and only of, a selected group of the operating elements. These elements can additionally be manipulated, in particular rotated, to select the group. The buttons of the selected group can be identified by respectively associated digits forming a code. The lock further comprises a slidable blocking plate blocking the rotation of the operating elements and cancelling means operable to cancel the blocking by the plate. The cancelling means includes a key barrel accessible for operation externally of the housing at a place, in particular the front of the housing, separate from the mounting face. Operation of the key barrel thus has the consequence of freeing the buttons for rotation to change the code.

29 Claims, 1 Drawing Sheet

(56) References Cited

U.S. PATENT DOCUMENTS

| | | | | |
|---|---|---|---|---|
| 6,575,004 | B2 * | 6/2003 | Berton et al. | 70/313 |
| 7,043,948 | B1 * | 5/2006 | Wang | 70/214 |
| 7,316,139 | B2 * | 1/2008 | Nakazima et al. | 70/214 |
| 7,318,331 | B2 * | 1/2008 | Miao | 70/214 |
| 7,367,207 | B2 * | 5/2008 | Yang | 70/284 |
| 7,444,844 | B1 | 11/2008 | Lee | |
| 7,628,047 | B2 * | 12/2009 | Lee | 70/284 |
| 7,958,757 | B1 * | 6/2011 | Lee | 70/21 |

* cited by examiner

LOCK

CROSS REFERENCE TO RELATED APPLICATIONS

This application is a National Stage of International Application No. PCT/GB2009/002656 filed Nov. 12, 2009, claiming priority based on British Patent Application No. 0820823.3, filed Nov. 13, 2008, the contents of all of which are incorporated herein by reference in their entirety.

The present invention relates to a lock, especially a lock operated by a selected number of buttons or other operating elements.

Coded or combination locks in which release of a locking mechanism, for example to allow retraction of a latch from an apertured striker plate, is by actuation of buttons in accordance with a code have existed on the market for many years and their principles of construction are well-known. These locks have the advantage that a separate unlocking device, such as a conventional key or other tool with appropriately shaped shank, is not required for operation of the lock and the buttons are easy to operate. All that is required is knowledge of the particular buttons to be operated, for which purpose the individual buttons are usually identified by respective symbols, whether numbers, letters or pictograms, and a code is formed from a selected group of these symbols to denote a selected group of buttons to be actuated. Each of the buttons is arranged to mechanically interact with a respectively associated tumbler or component of similar effect in a locking mechanism, in particular a component contributing to producing a locked state of the mechanism, but only those buttons belonging to the selected group are effective for the interaction; the remaining buttons are ineffective. Selection of the group of effective buttons from the total number of provided buttons, for example four from a total of ten, is usually made on a default basis by the manufacturer or supplier of the lock and the lock is supplied with a record of the code identifying the selected group of buttons. Although the selected group is identified by a code formed by a specific sequence of the symbols associated with the buttons of the group, it is usually not necessary in the case of a mechanical lock to adhere to the specific sequence, provided all the buttons—and only those buttons—associated with the symbols in the code are actuated.

Selection of the buttons to make up the group is normally achieved by location of each button of the selected group in a first or effective rotational setting in which it is capable of interaction, especially by the blocking of movement, with the associated tumbler or equivalent component in the locking mechanism. Deselection or exclusion from the group is achieved by location in a second or ineffective rotational setting, for example a setting displaced by 180 degrees relative to the first setting, in which interaction is prevented and the associated tumbler or equivalent component does not contribute to retaining the locking mechanism in the locked state. Consequently, for default selection of the group of effective buttons the manufacturer or supplier locates each the buttons of the group in the first rotational setting and each of the remaining buttons in the second rotational setting. This task is relatively straightforward when the lock is in the hands of the manufacturer or supplier and prior to installation of the lock.

One form of known lock of the kind in question has the capability of user change of the selected group of effective buttons. This change may be needed not only to initially adapt the identifying code of those buttons to user preference, but also to change the code in the event of compromise or potential compromise of security, for example knowledge of the code by persons not authorised or no longer authorised to again access to areas protected by the installed lock. A known means of allowing user change involves provision, at a mounting face of the lock, of a removable panel which cooperates with the buttons, more specifically with operating parts of the locking mechanism associated with the buttons, to lock them in one or other of the effective and ineffective rotational settings. When the panel is removed, the mentioned operating parts of the individual buttons are freed for turning to a different one of the rotational settings and thus for including the associated buttons in or excluding them from the selected group of effective buttons. When the new selection has been made, the panel is replaced. However, the panel is located at a mounting face of the lock, namely at a side of a housing of the lock intended to be placed against the surface of a door, hatch or other openable element, and removal of the panel necessarily obliges removal of the lock. This is generally carried out from the opposite side of the door or other element on which the lock is mounted and is a laborious process which usually entails disengagement and re-engagement of a spindle connecting handles on either side of the element. Removal of the lock, ostensibly from the secure side of a door or other element to be locked, provides security against tampering, in particular unauthorised change of the group of selected buttons, but with the penalty of a relatively high level of inconvenience in making the change. Demounting of the lock requires a tool or tools and also skills which are often not possessed by users, with the result that specialist outside assistance may be needed. This entails expenditure of both time and cost.

The principal object of the invention is therefore provision of a simplified means of setting or changing the selected group of effective operating elements, such as buttons, of a lock operable by way of such elements, in particular by permitting change in the selection without requiring demounting of the lock after installation.

A subsidiary object is provision of a change facility which is convenient to perform, but nevertheless secure against tampering.

Yet another object is combination of the change facility with another feature of the lock so as to minimise the extent of apparent modification to existing and familiar lock formats.

Other objects and advantages of the invention will be apparent from the following description.

According to the present invention there is provided a lock comprising a housing defining a mounting face, a locking mechanism accommodated in the housing and operable to change between a locking state and a release state, a plurality of operating elements accessible externally of the housing and actuable to operate the locking mechanism, the locking mechanism being operable to change from the locking state to the release state in response to actuation of and only of a selected group of the operating elements and the operating elements additionally being manipulable to make the selection, the actuation and manipulation of the operating elements being by different motions, blocking means blocking the manipulation of the operating elements and cancelling means operable to cancel the blocking by the blocking means, the cancelling means being accessible—for operation—externally of the lock at a location on the housing other than the mounting face.

A lock embodying the present invention has the advantage that the selected operating elements making up the group effective to change the locking mechanism from its locking state, in which, for example, it prevents transmission of motion to a latch, bolt or other securing component, to its release state, in which, for example, it allows transmission of such motion, can be changed by the user by action at a location on the lock housing away from the side with the mounting face. Consequently, there is no requirement to remove an installed lock in order to change the operating element or button selection or, in conventional parlance, the lock code, i.e. the set of digits or other symbols identifying the elements in the selected group. The operating elements actuable to operate the locking mechanism have the additional capability of manipulation, separate from actuation for locking mechanism operation, to make the selection, whether at the outset or in substitution for the default choice of the manufacturer or supplier. This capability is, however, inhibited unless overridden by the cancelling means, which is accessible for operation without requiring the user to demount the lock. Moreover, since the actuation and manipulation of the operating elements are by different motions, especially rotation in the case of the manipulation and axial displacement for the actuation, performance of the two different functions of the operating elements by these motions provides a clear distinction in use of the elements. This is not only beneficial for user understanding of the lock operation—which in the case of some locks can be overly complex—but also significantly contributes to simplified instruction of the lock. Specific components can interact with the operating elements in clearly defined and different ways depending on the motion of the operating element, for example rotation or axial displacement, and this avoids the need for an unduly complicated form of operating elements and co-operating components, such as components with multiple springs, detent balls and the like.

The cancelling means is, for preference, accessible for operation at a side of the housing opposite the mounting face, advantageously at a front face of the lock housing where the operating elements themselves are accessible. The lock components requiring actuation by a user can thus be conveniently grouped in close proximity to one another.

The cancelling means preferably comprises drive means for imparting motion to the blocking means to cancel the blocking, such drive means being conveniently enclosed in the housing and thus concealed from view. Various principles of transmission can be employed for imparting the motion, a preferred method being means for translating rotational motion into linear motion, for example, by way of eccentric means such as a cam or other component having the effect of a cam.

Security of the lock, in particular of the facility for changing the selection of effective operating elements, can be conveniently achieved by arranging the drive means to be key-operated. Key operation can entail, for example, insertion of a key into a conventional key barrel to disengage rotation-inhibiting tumblers and then rotation of the barrel by turning the inserted key. Other methods of preventing unauthorised manipulation of the operating elements of the lock are equally possible. If the key method is used, however, it can then be advantageous, if the lock additionally includes an angularly movable handle lockable and releasable by the locking mechanism, for the drive means to comprise a key barrel incorporated in the handle.

A significant economy in construction of the lock can be realised if the cancelling means is additionally operable as an override to unlock the handle independently of operation of the locking mechanism by the actuating elements. An override device may in any case be provided in the lock, i.e. to allow overriding of the locking state of the locking mechanism so that the lock is ineffective, whereby, for example, the handle can be used for opening and closing a door or similar without any need to actuate the operating elements. This override function and the cancelling means are thus combined so that the drive means for imparting motion to the blocking means can be an extension of the override device, which is usually key-operated.

The blocking means preferably comprises a member mechanically positively engageable with the operating elements to prevent their manipulation to make the selection, but permitting actuation to operate the locking mechanism. Mechanically positive engagement, in which component shapes interact, represents a simple and economic means of blocking the manipulation. In a preferred embodiment, the manipulation of the operating elements involves rotation of the elements and the mechanically positive engagement is effective to prevent such rotation. In that case, each of the operating elements can be capable of rotation between a rotational setting which includes it in the selected group and a rotational setting which excludes it from the selected group.

For preference, the mechanically positive engagement is provided by mutual contact of juxtaposed surface portions respectively of the member and each of the operating elements. In a simple configuration of the blocking arrangement the operating elements extend in respective recesses, for example apertures, of the member and the surface portions are present in the recesses, these surface portions then being provided by, for example, co-operating edge walls of the recesses and circumferential surface portions of the operating elements. The co-operating edge walls of the recesses and circumferential surface portions of the operating elements are preferably straight, which is a basic and easily produced shape, but other shapes which block rotation of the elements relative to the member are equally possible.

In practice, manufacture of the lock is considerably eased if each of the operating elements is of multi-part construction, one part of which extends in the respective recess and the other or another part of which is accessible externally of the housing for actuation. The externally accessible part of each operating element can then comprise a substantially cylindrical button mounted in the housing to be capable of rotation and axial displacement. The two mentioned parts will for preference be coupled to be capable of relative axial displacement, but secure against relative rotation, so that the buttons can be depressed in order to operate of the locking means, but without thereby transmitting axial movement to the parts extending in the recesses. These parts thus remain in position in the recesses, but can rotate in the recesses—if the blocking by the blocking means is cancelled—to allow change of the rotational settings of the elements.

The member is for preference movable, for example slidably movable, between a setting in which it is engaged with the operating elements to prevent manipulation thereof and a setting in which it is disengaged from the operating elements to allow their manipulation. In that case, the member can be drivably coupled with the cancelling means to allow transfer of sliding motion to the member by the cancelling means. Guide means confining sliding movement of the member to a predetermined path can be included in the lock, in particular so as to ensure that the member can travel in the lock housing without binding under the force transmitted by the drive of the cancelling means.

The member is preferably movable by the cancelling means into at least the setting in which it is disengaged from the operating elements, but advantageously, also, into the setting in which it is engaged with the elements. This can be achieved by, for example, an eccentric, crank or dog drive captively associated with the member. However, provision can be made to return the member to the engaged setting by resilient means, such as a compression or tension spring, the force of which opposes movement of the member into the disengaged setting.

The member can take various forms, but in an economic construction consists a plate. This can be furnished with the mentioned recesses, in particular apertures, simply by stamping. The plate or other form of member is preferably arranged within the housing adjacent to a side thereof defining the mounting face, thus remotely from the preferred location of the accessible parts of the operating elements and cancelling means. A cover plate for covering the member and defining at least part of the mounting face can be incorporated in the housing and such a closure plate can form part of the guide means for guiding the sliding movement of the member.

The described lock features are particularly appropriate to a lock which is wholly mechanical in nature, but the lock could equally well be electromechanical. In addition, the lock is preferably of a kind in which the locking mechanism is operable in response to actuation of the operating elements of the selected group in any order, but the facility of changing the selected group of effective operating elements is also applicable to a lock in which the locking mechanism is operable in response to actuation of those operating elements in and only in a predetermined sequence.

An embodiment of the present invention will now be more particularly described by way of example with reference to the accompanying drawings, in which.

Figure 1:
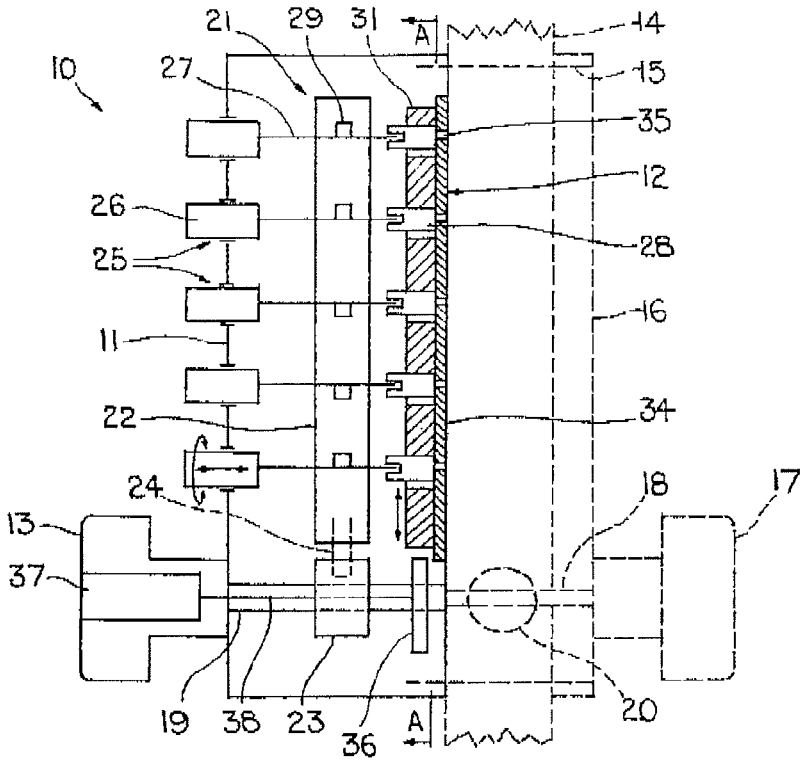
FIG. 1 is a schematic sectional side view of a lock embodying the invention, the lock being shown mounted on part of a door.

Referring now to the drawings there is shown in FIG. 1 a lock 10 which in the illustrated embodiment is of wholly mechanical construction and is typically used for securing a door to a surround. The lock 10 comprises a housing 11, which is illustrated as a simple oblong form, but which in practice will be a cast metal or metal alloy cavity body with a contoured front side, for example recessed to partly shroud and thus protect control components protruding from the body. At its side opposite the front side the housing defines a mounting face 12 by which the lock can be mounted on a surface. Arranged at the front side is a protruding handle 11 in the form of a lever or knob, the latter being shown.

The housing 11 is depicted mounted on one side of a door 14 with the mounting face 12 bearing against a surface of the door. Mounting is by way of screws 15 inserted from the other side of and passing through the door. The screws 15 by which the lock 10 is fitted and can be removed are thus accessible only from the side of the door remote from the lock, generally a side facing a secured area to which access is controlled by way of the lock. On that side of the door the screws also mount a fascia body 16 carrying a further handle 17, which is connected with the handle 13 by way of a spindle 18 and a coupling 19, the latter being part of the lock and composed of several interengaging components. In FIG. 1 the coupling 19 is for simplicity illustrated merely as a representative connecting sleeve. The body 16 and handle 17 are not part of the lock 10, but are normally supplied with the lock as part of a door locking kit. Similarly, the spindle is not part of the lock, but is included in the kit. The spindle usually has the form of a flat or square bar intended to be cut to length depending on the thickness of the door and is mechanically positively and removably engaged in a drive output (not specifically illustrated) of the coupling 19.

The spindle 18, when the kit inclusive of the lock is fitted, is intended to be non-rotatably engaged in a sliding latch 20 which is embedded in the door 14 and which when either one of the handles 13 and 17 is appropriately turned can be withdrawn from the aperture of an apertured striker plate (not shown) mounted on the door surround. On withdrawal of the latch or retraction thereof into the door, the door can be opened. The latch will usually be spring-loaded for return to an extended position in which it is re-engaged in the striker plate as soon as soon as the handle which has been turned is released. The coupling 19 is constructed so that if the handle 17 is turned the spindle 18 is rotated to retract the latch 20 without transmission of drive to the handle 13, i.e. the coupling 19 in that case accommodates an idle motion of the spindle.

Arranged in the housing 11 of the lock 10 is a locking mechanism 21 which functions to prevent rotation of the handle 13 and thus rotation of the spindle 18 and retraction of the latch 20. It would also be possible for the locking mechanism 21 to decouple the handle 13 from the coupling 19 in terms of drive so that the handle idly rotates without transmission of drive via the coupling and spindle to the latch. Principles of construction and operation of locking mechanisms of the kind usable in the lock 10 are well-known in the art and accordingly a specific construction and mode of operation of the locking mechanism 21 are not discussed. In the illustrated and merely diagrammatic form, the locking mechanism 21 comprises a stationary part 22 mounted in a fixed location in the housing 11 and a rotary part which is a functional part of the coupling 19 and thus an intermediary in the transmission of drive from the handle 13 to the lock drive output and ultimately the spindle 18. The stationary part 22 of the mechanism 21 includes a sliding locking bar 24, indicated in part by dashed lines, movable upwardly and downwardly in the stationary part 22 for engagement with and disengagement from the rotary part 23. When the bar 24 is so engaged, rotation of the rotary part 23 and thus the coupling 19 and spindle 18 by the handle 13 is prevented and the locking mechanism is in a locking state. When the bar is disengaged from the rotary part 23, rotation of that part and the mentioned associated components of the lock is possible and the locking mechanism is in a release state.

Operation of the locking mechanism 21 to change from the locking state to the release state is by way of operating elements 25 accessible for actuation at the front side of the housing 11. The elements 25, of which ten are provided in the illustrated embodiment, are arranged in two vertical rows of five (only one row visible in FIG. 1). Each operating element 25 comprises a button 26 journalled in a shrouded panel area at the front side of the housing 11 to be both rotatable and axially displaceable, the latter motion being subject to a resilient bias tending to urge the button in a direction away from the housing into a rest position. Actuation of each operating element 25 to operate the locking mechanism 21 as described further below is by way of depressing the respective button 26, which is subsequently returned to its rest position by the resilient bias. Each button 26 is connected with a plurality of intercoupled functional elements, which for simplicity are represented in FIG. 1 merely by a line 27, and at the distal end of the line with a shaped head 28. Each of the operating elements 25 can be rotated by way of its button 26 between an effective rotational setting and an ineffective rotational setting displaced by 180 degrees relative thereto. In the effective rotational setting the operating element 25 concerned participates in operation of the locking mechanism 21, in particular transfer of the mechanism from its locking state to its release state. The participating elements 25 constitute a selected group of elements, for example five of the ten, usable to operate the locking mechanism, whereas those elements 25 in the ineffective rotational setting are entirely excluded from participating in operation of the locking mechanism. The elements 25 are identified by numbers marked on the shrouded panel area respectively adjacent to the buttons 26. The particular numbers associated with the selected elements 25 thus provide a code by which, in effect, the lock as a whole is controlled.

By way of arbitrary example, the respective rotational settings of the individual operating elements 25 are indicated by lateral protrusions from the lines 27, those protrusions pointing upwardly denoting the effective rotational setting in which the associated operating elements 25 are capable of interaction with the sliding lock bar 24 and those pointing downwardly denoting the ineffective rotational setting in which the associated elements 25 are incapable of such interaction. In the illustrated example the top two and the lowermost operating elements 25 in the row are in the effective rotational setting and the remaining two in the ineffective rotational setting. If the elements 25 in this row are arbitrarily numbered 1 to 5 from the top, the numbers 1, 2 and 5 are thus part of the multi-digit (usual four or five) code established to control the lock. In the present case the operating elements 25 associated with the code digits can be actuated in any order, as distinct from the specific sequence embodied by the code, to operate the locking mechanism.

For reasons connected with the interaction of the operating elements 25 with the locking mechanism 21 the elements 25 of one vertical row are rotatable in clockwise sense as seen from the front side of the lock, and those of the other row in anticlockwise sense, in order to adopt the same rotational setting, for example the effective rotational setting. The respective rotational sense is fixed by a rotational constraint described further below.

The interaction between the operating elements 25 and the bar 24 is determined by the functional elements present in the lines 27. When an element 25 in the effective rotational setting is axially displaced by depressing its button 26 a functional element in the associated line 27 is transiently transferred to a release state permitting motion of the sliding lock bar 24. The depressed button 26 is, on release, restored to its extended or rest state while the mentioned functional element remains in its release state. After actuation of all of the operating elements 25 in the selected group the bar is movable, in particular disengageable from the rotary part 23 of the locking mechanism 21, and the mechanism is thereby in its release state. Following turning of the handle 13, which is now possible, to retract the latch 20 and thereafter release of the handle and return of the latch to its extended position, the locking mechanism 21 automatically returns to its locking state. This includes return of the functional elements in the lines 27 of the operating elements to their former state in readiness for the next operation of the locking mechanism. Various forms of construction of such a locking mechanism and associated operating elements and methods of interaction are well-known and accordingly have been outlined only in terms of basic principles and illustrated by representative components. The invention is not concerned with the construction and operation of the locking mechanism as such.

Figure 2:
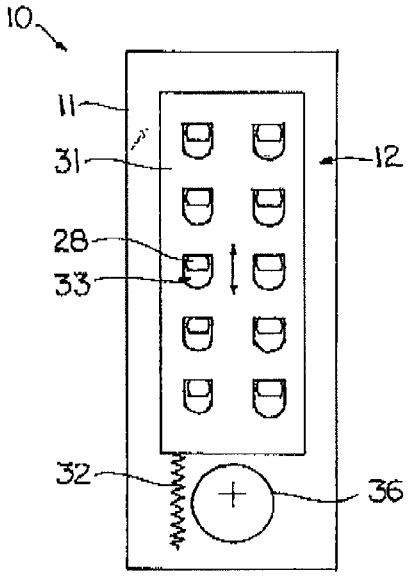
FIG. 2 is a schematic cross-section on the line A-A of FIG. 1, showing a blocked state of operating elements of the lock.
Figure 3:
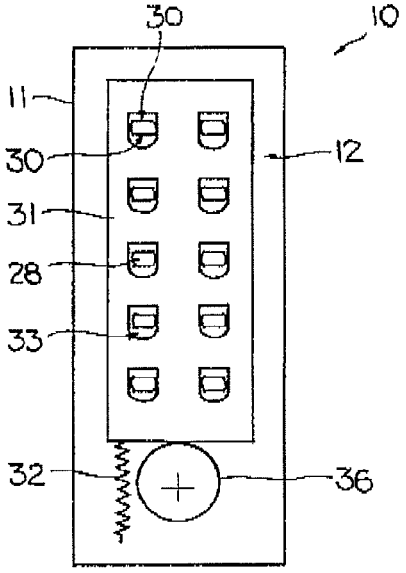
FIG. 3 is a view similar to FIG. 2, but showing an unblocked state of the elements.

Each of the heads 28 at the ends of the operating elements 25 remote from the buttons 26 has the form of a disc or cylinder with two diametrically opposite flats or planar faces 30, as can be seen in FIGS. 2 and 3. Each head 28 is coupled with the associated button to be rotatable with the button, but not axially displaceable therewith; a sliding coupling of each head with the functional elements forming the associated line 27 is shown in FIG. 1 by way of diagrammatic representation. Depending on the rotational setting—effective or ineffective—of the respective operating element 25 one of the flats 30 faces upwardly and the other downwardly. The heads 28 co-operate with blocking means serving to block rotation of the actuating elements 25 between their rotational settings unless or until the blocking is cancelled as described below. The blocking means in the illustrated embodiment has the form of a blocking plate 31 mounted in the housing 11 for sliding movement parallel with the mounting face 12, in particular vertical movement. The plate is guided in such movement by guide means (not shown). The plate 31 is biased into a lowered position by a tension spring 32, which is illustrated merely by way of example. Other means of ensuring return of the plate to that position are equally possible.

The blocking provided by the plate 31 is achieved by engagement of each of the heads 28 in a respective aperture 33 in the plate, each aperture having a top boundary edge which is straight and a remaining boundary edge which is approximately semicircular with straight side extensions connected with the top edge. In the lowered position, which is a blocking position, of the plate 31 the straight top edge of each aperture 33 is in contact with or very closely adjacent to the upwardly facing flat 30 of the head 28 present in the aperture. As a consequence, rotation of the operating element 25, of which the head 28 forms part, is blocked. However, in the raised position of the plate 31 the straight top edges of the apertures 33 are spaced sufficiently far from the upwardly facing flats 30 of the heads 28 for the heads to be capable of rotation in the apertures—assuming an appropriate relationship of the sizes of the heads and the apertures—and thus transfer of the operating elements 25 between their rotational settings. Accordingly, it is now possible to turn any of the actuating elements 25, by way of the buttons 26, through 180 degrees from the effective or ineffective rotational setting into the respective other setting in order to correspondingly change the selected group of elements participating in operation of the locking mechanism 21. On return of the plate 31 to its lowered position, such as by the influence of the spring 32, the straight top edges of the apertures 33 are again brought into contact with or close proximity to the upwardly facing flats 30 of the heads 28 to restore blocking of the rotation of the actuating elements 25.

The plate 31 is covered by a cover plate 34 which is detachably secured to the body of the housing 11 and defines at least a part of the mounting face 12 as well as, if desired, forming part of the guide means for the sliding motion of the plate 31. The cover plate 34 can be provided with openings into which off-centre spigots 35 on the heads 28 project. The openings are shaped to so co-operate with the spigots 35 as to permit rotation of the actuating elements 25 from a given one of the rotational settings to the other rotational setting in only one rotational sense, i.e. in clockwise or anticlockwise sense as determined by a viewing direction. The shape of the openings associated with one vertical row of elements 25 is inverted relative to that of the openings associated with the other row, with the consequence that the buttons 26 in one row are rotatable in one rotational sense into, for example, the effective rotational setting and the buttons of the other row are rotatable in the opposite rotational sense into the same setting.

The lock 10 includes cancelling means to cancel the blocking of the capability of the actuating elements 25 to rotate. The cancelling means for this purpose comprises an eccentric 36 which acts on the lower edge of the plate 33 and is rotatable to lift the plate into its raised position against the bias of the spring 32, as indicated by the change in component settings between FIG. 2 and FIG. 3. The spring restores the lowered position of the plate as soon as the eccentric 34 is rotated or allowed to rotate back to its initial position depicted in FIG. 2. The eccentric 36 is merely an arbitrary example of a displacing drive for the plate. In practice, the drive can have the form of a cam, crank, pivot arm, off-centre dog wedge, ramp or any other suitable drive, preferably one translating rotational or angular motion into linear motion.

Rotation of the eccentric 36 is achieved by action at a location of the housing 11 readily accessible even when the lock 10 is fitted, in particular a location separate from the mounting face 12. This location is, in the illustrated embodiment, at the front side of the housing 11. For this purpose the handle 13 incorporates a key barrel 37 which is coupled to the eccentric 36 for transmission of rotary drive thereto. The coupling of the key barrel 37 with the eccentric 36 is provided by coupling elements represented schematically by a line 38 passing through the coupling 19 connecting the handle 13 with the spindle 18. The barrel is rotatable by insertion of a key (not shown) to release a conventional key-operated locking system contained in the barrel and then by turning the key. Rotation of the barrel 37 in turn rotates the eccentric 36 by way of the coupling line 38. Return rotation of the barrel and thus the eccentric is either by way of reverse rotation of the key or by a spring assist effective when the key is released. Withdrawal of the key results in automatic restoration of the locking system in the barrel to its locked state.

An additional function of the key barrel 37 is overriding of the effect of the locking mechanism, for which purpose the elements present in the line 38 interact with the rotary part 23 of the locking mechanism 21 in such a way that even when the locking mechanism is in its locked state the rotary part allows turning of the handle 13 if the key barrel 37 has been turned by the inserted key. This override facility is a feature of known locks and therefore not described in more detail. However, in this instance the key barrel has a dual function, namely cancelling of the blocking provided by the plate 33 so that the rotational settings of the actuating elements 25 can then be changed. Use is thus made, for the cancelling function, of components of the override facility, which not only reduces the complexity of operation of the different features of the lock, but also enhances economy of construction and retains a lock format familiar to users. Change in the group of buttons 26 used for releasing the lock, i.e. the lock control code, simply requires the two actions of turning the key and rotating the relevant buttons, which is straightforward to perform and does not oblige demounting of the lock. At the same time, assignment of the code changing facility to a key-operated component ensures security against change in the code by anyone without access to the key.

The invention claimed is:

1. A lock comprising a housing having a first side and a second side opposite the first side, the housing defining a mounting face at said second side, a locking mechanism accommodated in the housing and operable to change between a locking state and a release state, a plurality of operating elements accessible externally of the housing at said first side thereof and actuable by axial displacement to operate the locking mechanism, the locking mechanism being operable to change from the locking state to the release state in response to axial displacement of and only of a selected group of the operating elements and the operating elements additionally being manipulable by rotation to make the selection, blocking means for blocking the rotation of the operating elements, and cancelling means operable to cancel the blocking by the blocking means, the cancelling means being accessible — for operation — externally of the lock at a location on the housing other than the mounting face, said location being at said first side of the housing opposite the mounting face.

2. A lock as claimed in claim 1, the cancelling means comprising drive means for imparting motion to the blocking means to cancel the blocking.

3. A lock as claimed in claim 2, the drive means being rotatable to impart the motion.

4. A lock as claimed in claim 3, the drive means comprising means to translate rotational motion into linear motion.

5. A lock as claimed in claim 3, the drive means comprising eccentric means.

6. A lock as claimed in claim 2, the drive means being key-operated.

7. A lock as claimed in claim 6, comprising an angularly movable handle lockable and releasable by the locking mechanism, the drive means comprising a key barrel incorporated in the handle.

8. A lock as claimed in claim 7, the cancelling means additionally being operable as an override to unlock the handle independently of operation of the locking mechanism by the actuating elements.

9. A lock as claimed in claim 1, the blocking means comprising a member mechanically positively engageable with the operating elements to prevent rotation thereof to make the selection, but permitting actuation thereof to operate the locking mechanism.

10. A lock as claimed in claim 9, wherein the mechanically positive engagement inhibits the rotation.

11. A lock as claimed in claim 10, wherein each of the operating elements is rotatable between a rotational setting which includes it in the selected group and a rotational setting which excludes it from the selected group.

12. A lock as claimed in claim 10, wherein the mechanically positive engagement is provided by mutual contact of juxtaposed surface portions respectively of the member and each of the operating elements.

13. A lock as claimed in claim 12, wherein the operating elements extend in respective recesses of the member and the surface portions are in the recesses.

14. A lock as claimed in claim 13, wherein the surface portions are provided by co-operating edge walls of the recesses and circumferential surface portions of the operating elements.

15. A lock as claimed in claim 14, wherein the co-operating edge walls of the recesses and circumferential surface portions of the operating elements are straight.

16. A lock as claim in claim 13, wherein the recesses are apertures.

17. A lock as claimed in claim 13, wherein each of the operating elements is of multi-part construction, one part of which extends in the respective recess and the other or another part of which is accessible externally of the housing for actuation.

18. A lock as claimed in claim 17, wherein the externally accessible part of each operating element comprises a substantially cylindrical button mounted in the housing to be capable of rotation and axial displacement.

19. A lock as claimed in claim 9, wherein the member is movable between a setting in which it is engaged with the operating elements to prevent manipulation thereof and a setting in which it is disengaged from the operating elements to allow manipulation thereof.

20. A lock as claimed in claim 19, wherein the member is slidably movable between the settings.

21. A lock as claimed in claim 20, wherein the member is drivably coupled with the cancelling means for transfer of sliding motion to the member by the cancelling means.

22. A lock as claimed in claim 20, comprising guide means confining sliding movement of the member to a predetermined path.

23. A lock as claimed in claim 19, wherein the member is movable by the cancelling means into at least the setting in which it is disengaged.

24. A lock as claimed in claim 9, wherein the member comprises a plate.

25. A lock as claimed in claim 9, wherein the member is arranged within the housing adjacent to a side thereof defining the mounting face.

26. A lock as claimed in claim 25, wherein the housing comprises a cover plate covering the member and defining at least part of the mounting face.

27. A lock as claimed in claim 1, wherein the lock is wholly mechanical.

28. A lock as claimed in claim 1, wherein the locking mechanism is operable in response to actuation of the operating elements of the selected group in any order.

29. A lock as claimed in claim 1, wherein the locking mechanism is operable in response to actuation of the operating elements of the selected group in and only in a predetermined sequence.

* * * * *